US006138633A

United States Patent [19]

Prior

[11] Patent Number: 6,138,633

[45] Date of Patent: Oct. 31, 2000

[54] ENGINE OIL LUBRICATION

[75] Inventor: Gregory Paul Prior, Birmingham, Mich.

[73] Assignee: General Motors Corporation, Detroit, Mich.

[21] Appl. No.: 09/156,141

[22] Filed: Sep. 17, 1998

[51] Int. Cl.[7] ..... F01M 11/00

[52] U.S. Cl. ..... 123/196 R; 123/90.33; 123/196 M; 123/195 C

[58] Field of Search ..... 123/90.33, 196 R, 123/90.37, 90.38

[56] References Cited

U.S. PATENT DOCUMENTS

| | | | |
|---|---|---|---|
| 5,038,732 | 8/1991 | Matayoshi et al. | 123/193.5 |
| 5,058,542 | 10/1991 | Grayson et al. | 123/195 C |
| 5,309,878 | 5/1994 | Kandler et al. | 123/196 M |
| 5,642,701 | 7/1997 | Oswald et al. | 123/193.3 |
| 5,709,185 | 1/1998 | Aizawa et al. | 123/196 CP |
| 5,931,131 | 8/1999 | Hackett | 123/195 C |
| 5,992,355 | 11/1999 | Shichinohe | 123/195 AC |

*Primary Examiner*—Willis R. Wolfe

*Assistant Examiner*—Jason Benton

*Attorney, Agent, or Firm*—Laura C. Wideman; Karl F. Barr, Jr.

[57] ABSTRACT

An overhead cam engine having an engine lubrication system for delivering oil includes an engine block and a cylinder head having a deck face adapted for mating with the engine block. The deck face forms an acute angle with a horizontal plane of the engine block. A valve train has transverse camshaft journal bearing assemblies with pressurized oil orifices to lubricate the bearings, a camshaft rotatably supported by the cylinder head through the transverse camshaft journal bearing assemblies, cams disposed on the camshaft, and valves actuated by the cams. The cylinder head has a transverse bridging surface bridging the transverse camshaft journal bearing assemblies. A bore is positioned along the bridging surface with a gasket supported by the bridging surface about the bore. The gasket includes a sealing ring for sealing the bore and a plurality of oil directing fingers, wherein excess oil from the transverse camshaft journal bearing assemblies flows along the bridging surface and about the sealing ring of the gasket to the oil directing fingers positioned to target oil onto targeted components such as valve train components.

2 Claims, 3 Drawing Sheets

ENGINE OIL LUBRICATION

TECHNICAL FIELD

The invention is directed to a system for lubricating overhead cam (OHC) engines.

BACKGROUND OF THE INVENTION

Engine lubrication systems provide many functions such as wear protection, corrosion protection, and engine cooling. One drawback is that engine power is diverted to operating a high pressure oil pump to distribute oil through passages in the engine, which weighs against engine efficiency. Overhead cam engines present a challenge to adequately and reliably lubricate the valve train without creating an undue demand on the engine lubrication system.

In an OHC engine, excess oil may flow out of a camshaft journal bearing and return to an oil reservoir without lubricating other valve train components. This unpressurized oil presents an opportunity for providing lubrication to other valve train components.

SUMMARY OF THE INVENTION

The invention provides a gasket to take advantage of and manage excess oil discharged from a camshaft journal bearing. The gasket has integral fingers which provide a directing surface to target oil onto components requiring lubrication. The targeted components may include valve train components such as cams and roller cam followers. The gasket with fingers directs lubrication without imposing additional demands on the oil pump or reducing system oil pressure.

DESCRIPTION OF THE PREFERRED EMBODIMENT

Figure 1:
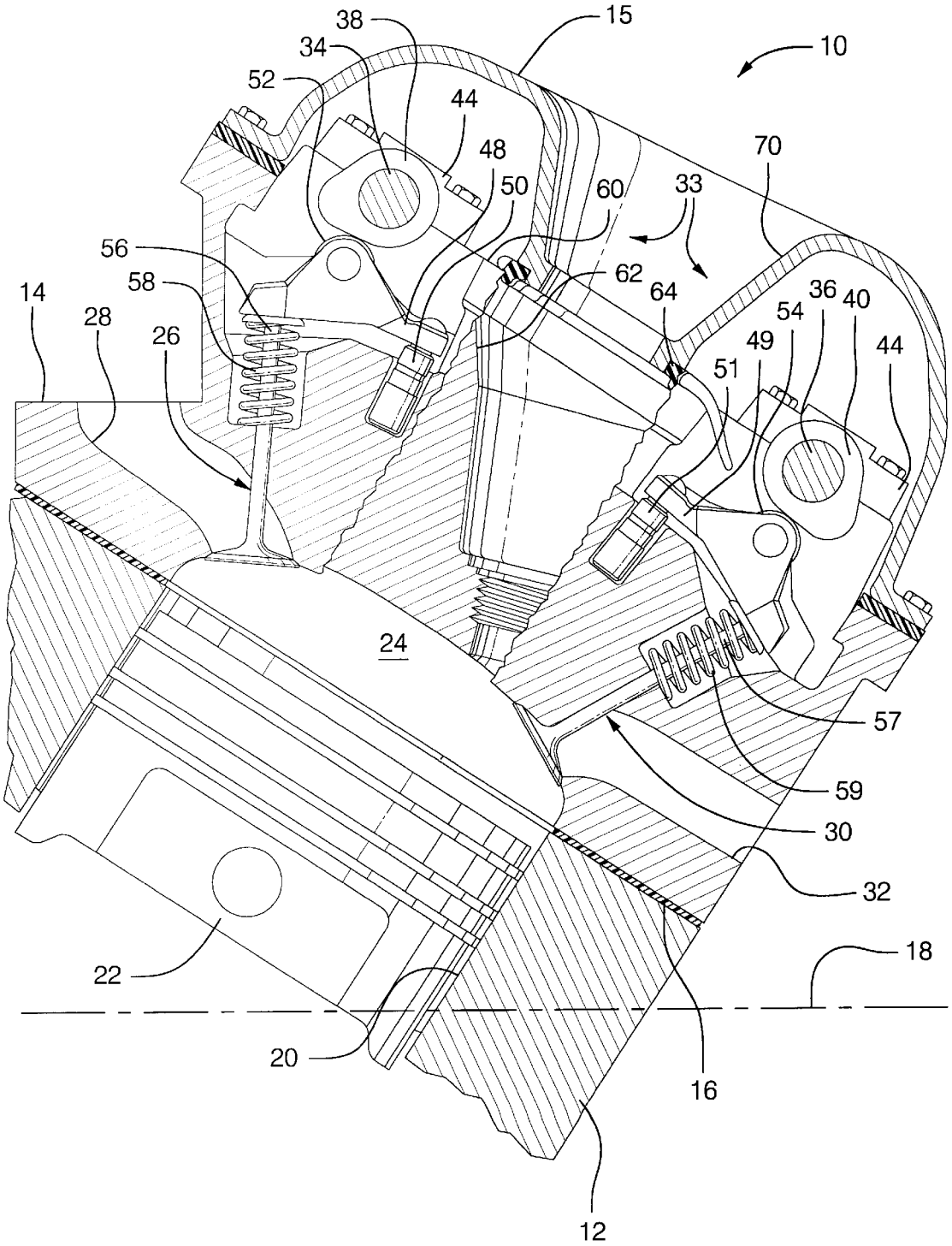
FIG. 1 is a schematic front view, taken along section 1—1 of FIG. 2, of a portion of a dual OHC engine embodying the present invention.
Figure 2:
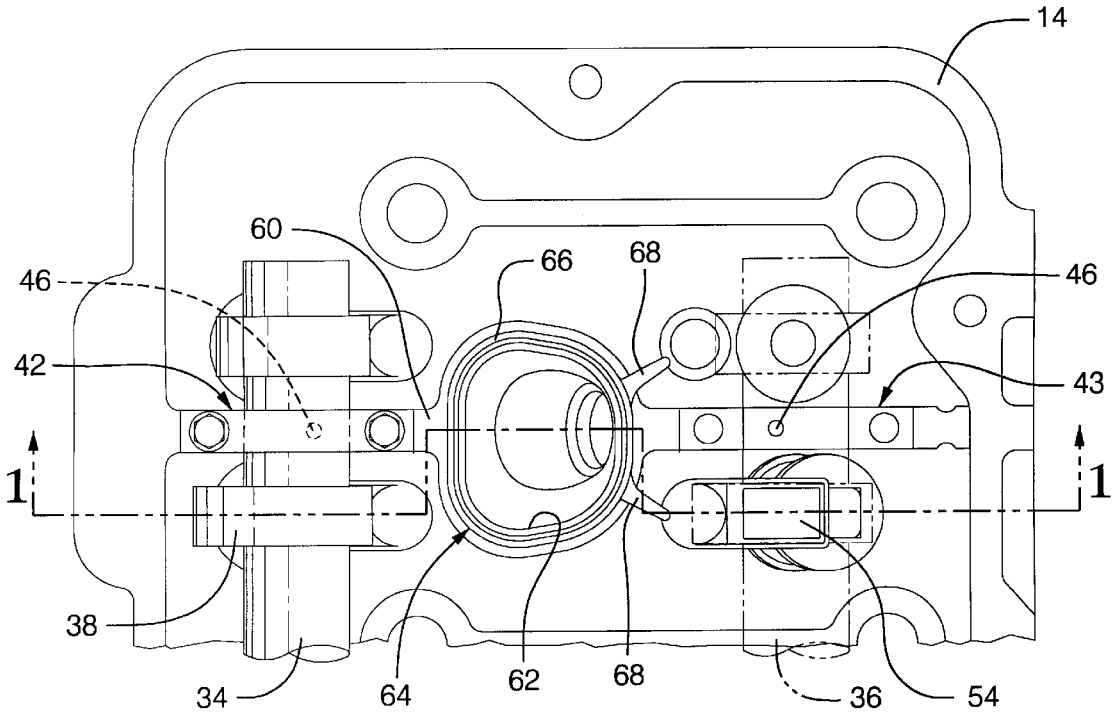
FIG. 2 is a plan view of a portion of the engine of FIG. 2.

In FIGS. 1 and 2 there is illustrated a dual OHC engine, generally referred to as 10. The engine 10 represents one bank of a V-configured engine or an inclined in-line configured engine. The engine 10 includes two main components, an engine cylinder block 12 and an engine cylinder head 14 where the cylinder head 14 is mounted on the cylinder block 12 and a valve cover 15 covers the head. The head 14 has a deck face 16 which forms an acute angle with a horizontal plane 18 when the head 14 is mated to the cylinder block 12. Each cylinder block 12 has a plurality of engine cylinders 20. An engine piston 22 is disposed within each cylinder 20 for reciprocal movement. The piston 22 and the cylinder head 14 cooperate to define a combustion chamber 24 therebetween.

Each cylinder 20 has an intake valve 26 to supply air, and fuel in some applications, to the combustion chamber 24 from an intake passage 28, and an exhaust valve 30 to exhaust the combustion gases through an exhaust passage 32. The intake valve 26 is seated in the end of the intake passage 28 which adjoins the cylinder 20 and the exhaust valve 30 is seated in the end of the exhaust passage 32 which adjoins the cylinder 20.

A valve actuation assembly, referred to as a valve train 33, includes the intake and exhaust valves 26,30 and parallel camshafts 34 and 36. Camshaft 34 is referred to as the upper camshaft and camshaft 36 is the lower camshaft as a consequence of their positioning in tilted cylinder banks. The cylinder head 14 rotatably supports the two parallel longitudinal camshafts 34,36 by upper and lower transverse camshaft journal bearing assemblies 42 and 43, FIG. 2. Camshaft bearing caps 44 are bolted to the head 14 to secure the camshafts 34,36 thereto. The camshaft journal bearing assemblies 42,43 are lubricated by pressurized oil orifices 46 in the head 14.

Upper and lower cams 38 and 40 of the camshafts 34, 36, actuate the intake and exhaust valves 26,30 via cam rocker arms 48,49. Upper and lower camshafts may operate either intake or exhaust valves depending on the application. In the end-pivot configuration shown, the cam rocker arms 48,49 pivot at a first end on stationary lash adjusters 50,51 that are assembled in the head 14. Along the cam rocker arms 48,49, the arms contact the upper and lower cams 38,40 directly through upper and lower roller cam followers 52 and 54 respectively. At a second end, the cam rocker arms 48,49 actuate valve stems 56,57 to open valves 26,30. Valve return springs 58,59 act to return the rocker arms 48,49 and close the valves 26,30. Other cam rocker arm configurations may be used such as a center-pivot configuration.

A bridging, single-planed surface 60 of the engine cylinder head 14 connects the upper and lower camshaft journal bearing assemblies 42,43 along their common transverse axis. A spark plug bore 62 interrupts the bridging surface 60, between the upper and lower camshafts 34,36. A spark plug, not shown, is installed in the spark plug bore 62. It is desirable to position the spark plug intermediate of the camshafts such that the spark plug is directed to the middle of the combustion chamber to minimize flame travel, thereby reducing the likelihood of detonation, and facilitating combustion.

Figure 3:
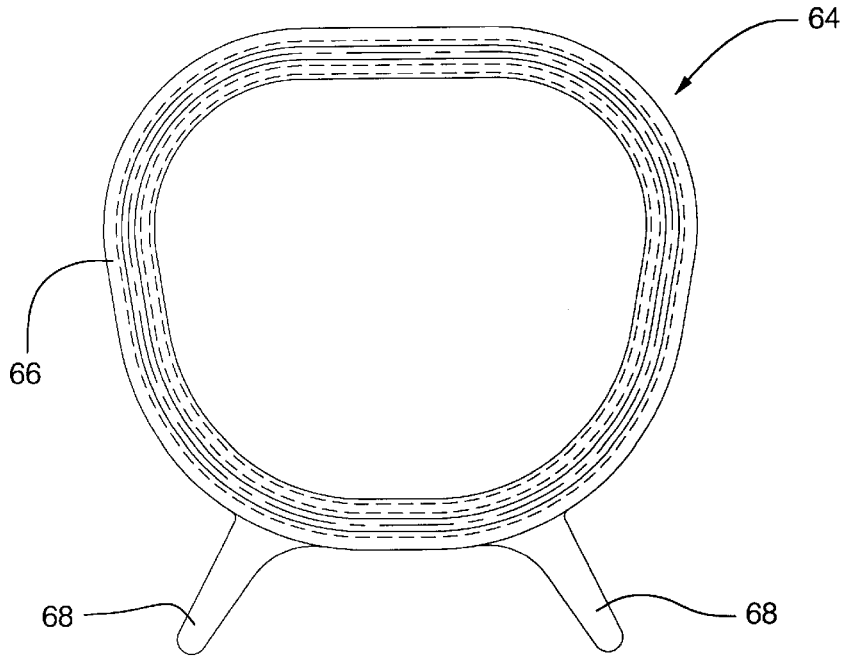
FIG. 3 is a plan view of the present invention.

A spark plug gasket 64, installed about the spark plug bore 62, is supported by the bridging surface 60 and is operable to prevent oil from entering the combustion chamber 24 through the spark plug bore. As shown in FIG. 3, the gasket 64 is comprised of a generally annular sealing ring 66, shaped to match the bore 62, and a plurality of integral oil directing fingers 68 affixed to the ring and pointing away from the bore. The gasket sealing ring 66 is captured by a spark plug boss 70 in the valve cover 15 to seal the spark plug bore 62 against ingress of oil.

Figure 4:
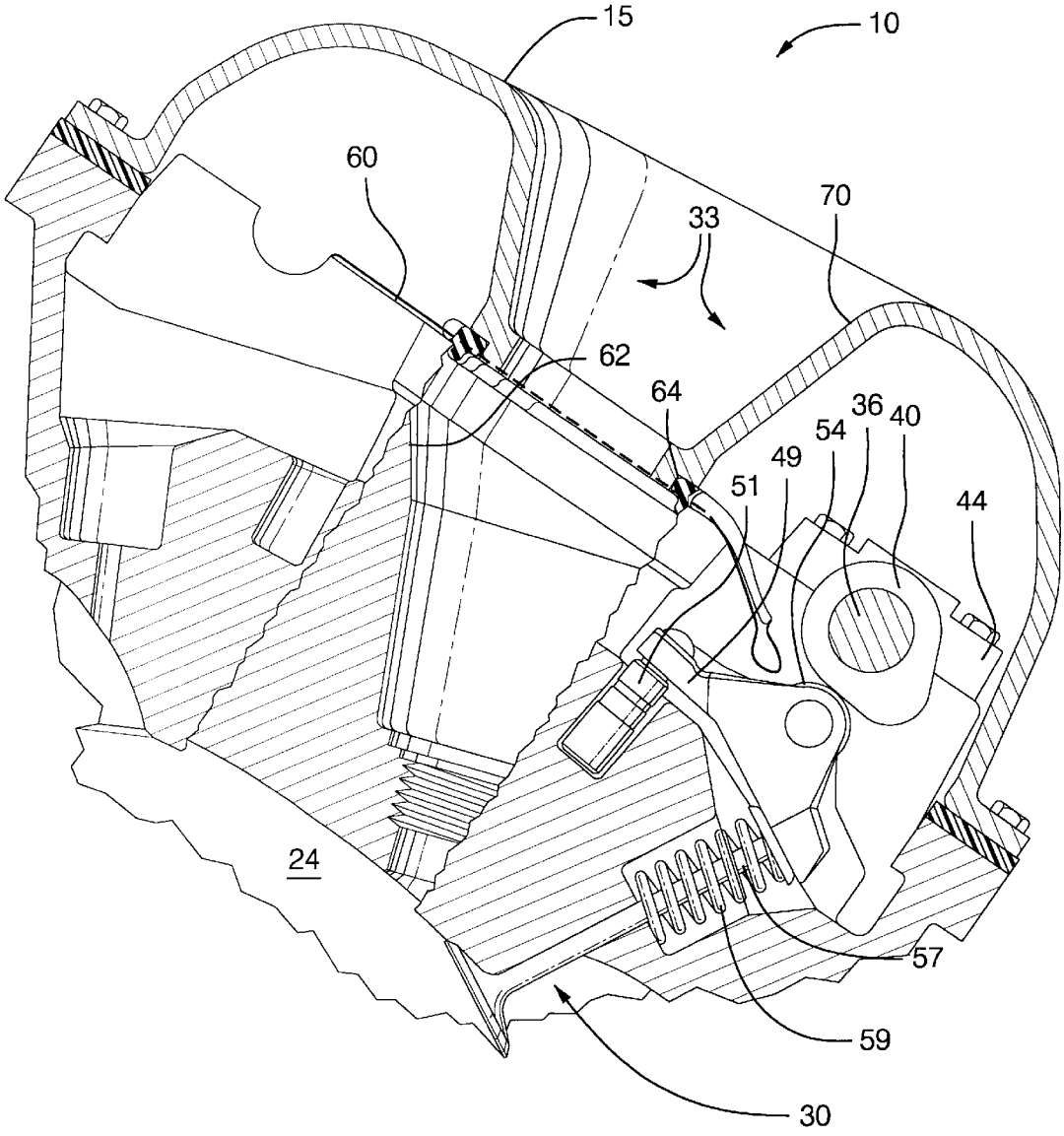
FIG. 4 is a schematic front view of a portion of the engine of FIG. 1 illustrating the present invention during operation.

During operation of the dual OHC V-engine or inclined in-line engine, excess oil from the upper camshaft journal bearing assembly 42 flows along the bridging surface 60 of the engine cylinder head 14 and about the sealing ring 66 of the spark plug gasket 64. The oil directing fingers 68 of the spark plug gasket 64 provide a surface for oil to flow away from the bore 62, such that the oil will drip onto targeted components for instance lower roller cam followers 54 or other valve train components as illustrated in FIG. 4. The quantity and size of the fingers 68 depend on how many lubrication targets there are, the configuration of the engine package, and the volume of excess oil.

The invention disclosed herein allows oil that has been used in a first lubrication of the camshaft bearings to be efficiently reused in a second location without requiring system oil pressure.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. An overhead cam engine with an engine lubrication system for delivering oil onto a targeted component comprising an engine block, a cylinder head having a deck face adapted for mating with said engine block, said deck face forming an acute angle with a horizontal plane of said engine block when mated therewith, a valve train comprising a transverse lubricated camshaft journal bearing assembly, a camshaft rotatably supported by said cylinder head in said transverse camshaft journal bearing assembly, said cylinder head further comprising a spark plug bore, a transverse bridging surface bridging said transverse camshaft journal bearing assembly and said spark plug bore, a gasket supported by said bridging surface about said spark plug bore, said gasket including a sealing ring for sealing said spark plug bore and an oil directing finger, wherein excess oil from said transverse camshaft journal bearing assembly flows along said bridging surface and about said sealing ring of said gasket to said oil directing finger positioned to target oil onto the targeted component.

2. A dual overhead cam engine with an engine lubrication system for delivering oil onto a targeted component comprising an engine block, a cylinder head having a deck face adapted for mating with said engine block, said deck face forming an acute angle with a horizontal plane of said engine block when mated therewith, a valve train comprising upper and lower transverse camshaft journal bearing assemblies including pressurized oil orifices to lubricate said upper and lower journal bearing assemblies, an upper and a lower camshaft rotatably supported by said cylinder head through said upper and lower transverse camshaft journal bearing assemblies respectively, cam rocker arms, upper and lower roller cam followers, said upper camshaft including upper cams operable to pivot said cam rocker arms through rolling contact with said upper roller cam followers, said lower camshaft including lower cams that pivot said cam rocker arms through rolling contact with said lower roller cam followers, and valves actuated by pivoting of said cam rocker arms, said cylinder head further comprising a transverse bridging surface bridging said upper and lower transverse camshaft journal bearing assemblies, a spark plug bore positioned along said bridging surface, a spark plug gasket supported by said bridging surface about said spark plug bore, said gasket including a sealing ring for sealing said spark plug bore and a plurality of oil directing fingers, wherein excess oil from said upper transverse camshaft journal bearing assembly flows along said bridging surface and about said sealing ring of said gasket to said oil directing fingers positioned to target oil onto said valve train.

* * * * *